US009359756B2

(12) United States Patent
Hardy

(10) Patent No.: US 9,359,756 B2
(45) Date of Patent: Jun. 7, 2016

(54) STEEL BEAM SUPPORT EMBED AND METHODS OF USE THEREOF

(71) Applicant: Timothy Hardy, Fairfax, VT (US)

(72) Inventor: Timothy Hardy, Fairfax, VT (US)

(73) Assignee: JenCol Innovations, LLC, Colchester, VT (US)

( * ) Notice: Subject to any disclaimer, the term of this patent is extended or adjusted under 35 U.S.C. 154(b) by 0 days.

(21) Appl. No.: 14/706,529

(22) Filed: May 7, 2015

(65) Prior Publication Data

US 2015/0322666 A1 Nov. 12, 2015

Related U.S. Application Data

(60) Provisional application No. 61/990,016, filed on May 7, 2014, provisional application No. 62/058,612, filed on Oct. 1, 2014.

(51) Int. Cl.

| | |
|---|---|
| ***E04B 1/16*** | (2006.01) |
| ***E04B 1/24*** | (2006.01) |
| ***E04B 1/41*** | (2006.01) |

(52) U.S. Cl.

CPC ..... *E04B 1/2403* (2013.01); *E04B 1/4114* (2013.01); *E04B 1/4121* (2013.01); *E04B 2001/2463* (2013.01)

(58) Field of Classification Search

CPC ... E04B 1/4114; E04B 1/4121; E04B 1/2403; E04B 2001/2463; E04C 5/0645

See application file for complete search history.

(56) References Cited

U.S. PATENT DOCUMENTS

| | | | | |
|---|---|---|---|---|
| 5,761,875 | A * | 6/1998 | Oliphant et al. | 52/649.4 |
| 6,298,630 | B1 * | 10/2001 | VeRost et al. | 52/712 |
| 7,240,464 | B2 * | 7/2007 | Oliphant et al. | 52/649.4 |
| 7,310,920 | B2 * | 12/2007 | Hovey, Jr. | 52/655.1 |
| 8,209,924 | B2 | 7/2012 | Foley | |
| 8,209,925 | B2 | 7/2012 | Foley | |
| 8,365,484 | B2 | 2/2013 | Foley | |

* cited by examiner

*Primary Examiner* — Andrew J Triggs

(74) *Attorney, Agent, or Firm* — Justin W. McCabe; Dunkiel Saunders Elliott Raubvogel & Hand PLLC

(57) ABSTRACT

An apparatus and method is disclosed that allows for the efficient installation and connection of steel beams to a concrete foundation. A steel beam support embed according to the present disclosure can be readily set in place during the forming of the concrete foundation via detachable anchors, thus allowing the installer to avoid rebar or other foundation components that would otherwise need to be moved or adjusted for proper placement of the embed. A steel beam support embed as disclosed herein also, after its installation in the concrete foundation, provides for adjustable connection to a steel beam without the need for field welding.

8 Claims, 9 Drawing Sheets

STEEL BEAM SUPPORT EMBED AND METHODS OF USE THEREOF

RELATED APPLICATION DATA

This application claims the benefit of U.S. Provisional Application Ser. No. 61/990,016, filed May 7, 2014 and titled "Steel Beam Support Embed and Methods of Use Thereof" and U.S. Provisional Application Ser. No. 62/058,612, filed Oct. 1, 2014 and titled "Steel Beam Support Embed and Methods of Use Thereof", each of which is hereby incorporated by reference herein in its entirety.

FIELD OF THE INVENTION

The present invention generally relates to building structure connectors. In particular, the present invention is directed to a Steel Beam Support Embed and Methods of Use Thereof.

BACKGROUND

Designers of buildings that will have concrete foundations and steel beams as structural members need to securely and accurately connect the beams to the foundation. Typically, this is accomplished using an embed, which is placed into the concrete foundation during the casting of the concrete such that a portion of the embed remains exposed for connection to a steel beam.

The steel beam is usually connected to the embed by first welding a small angle onto the embed for the beam to rest on. Once the beam is aligned properly, the beam is then welded to the embed along the longitudinal axis of the embed. After welding, the small angle is removed from the installation. This procedure to connect the steel beam to the concrete foundation is time consuming, induces errors in position, and produces significant stress on the embed at the weld.

SUMMARY OF THE DISCLOSURE

In a first exemplary aspect a steel beam support for attachment to a concrete form that defines an area to be filled with concrete is disclosed, the steel beam support comprising a plate having a plurality of apertures extending therethough, wherein said plate is couplable to the concrete form; a plurality of connecting ports coupled to said plate such that each of said plurality of connecting ports are substantially aligned with a corresponding respective one of said plurality of apertures; and a plurality of detachable anchors each removably coupled to a corresponding respective one of said plurality of connecting ports, and wherein, after attachment of the steel beam support to the concrete form, said plurality of detachable anchors extend from said plate into the area to be filled with concrete.

In another exemplary aspect a steel beam support embed for coupling a steel beam to a concrete foundation is disclosed, the steel beam support embed comprising: a plate having a first surface and a plurality of apertures extending therethrough; a plurality of first fastener attachments coupled to said first surface, each of said plurality of first fastener attachments substantially aligned with a corresponding respective on of said plurality of apertures; a plurality of detachable anchors each removably coupled to a corresponding respective one of said plurality of first fastener attachments; and a plurality of connecting ports, wherein each of said plurality of connecting ports includes: a casing coupled to said first surface; and a second fastener attachment disposed between said plate and said casing.

In yet another exemplary aspect a method of mounting a steel beam to a concrete wall is disclosed, the method comprising providing a steel beam embed; positioning the steel beam embed on a concrete form for the concrete wall; tacking the steel beam embed to the concrete form; coupling a plurality of detachable anchors to the steel beam embed, the plurality of detachable anchors extending into an area to be filled with concrete; coupling the steel beam to the steel beam embed.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DESCRIPTION OF THE DISCLOSURE

A steel beam support embed (also referred to herein as, the "embed") of the present disclosure provides for efficient installation and connection of steel beams to a concrete foundation. The steel beam support embed can be readily set in place during the forming of the concrete foundation via detachable anchors, thus allowing the installer to avoid rebar or other foundation components that would otherwise need to be moved or adjusted for proper placement of the embed. A steel beam support embed as disclosed herein also, after its installation in the concrete foundation, provides for adjustable connection to a steel beam without the need for field welding.

Figure 1:
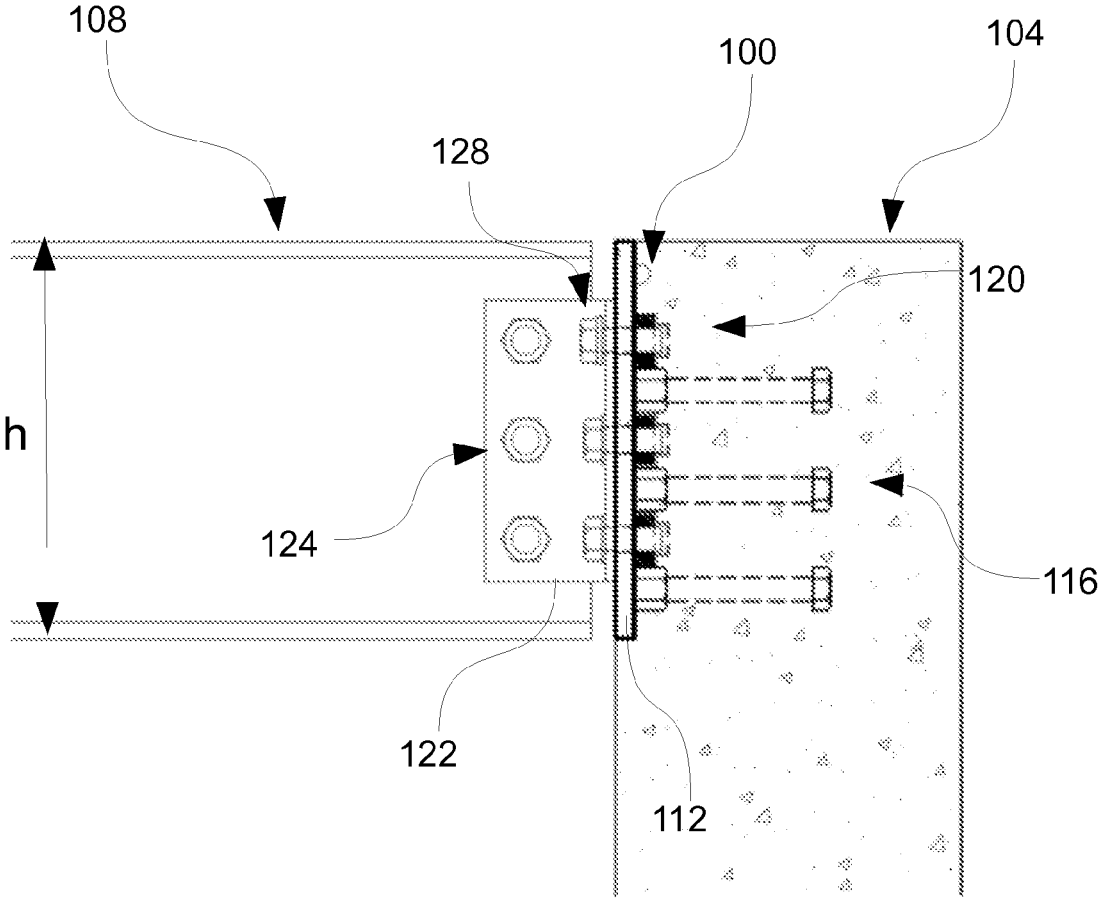
FIG. 1 is a section view of a steel beam support embed after installation according to an embodiment of the present invention.
Figure 2:
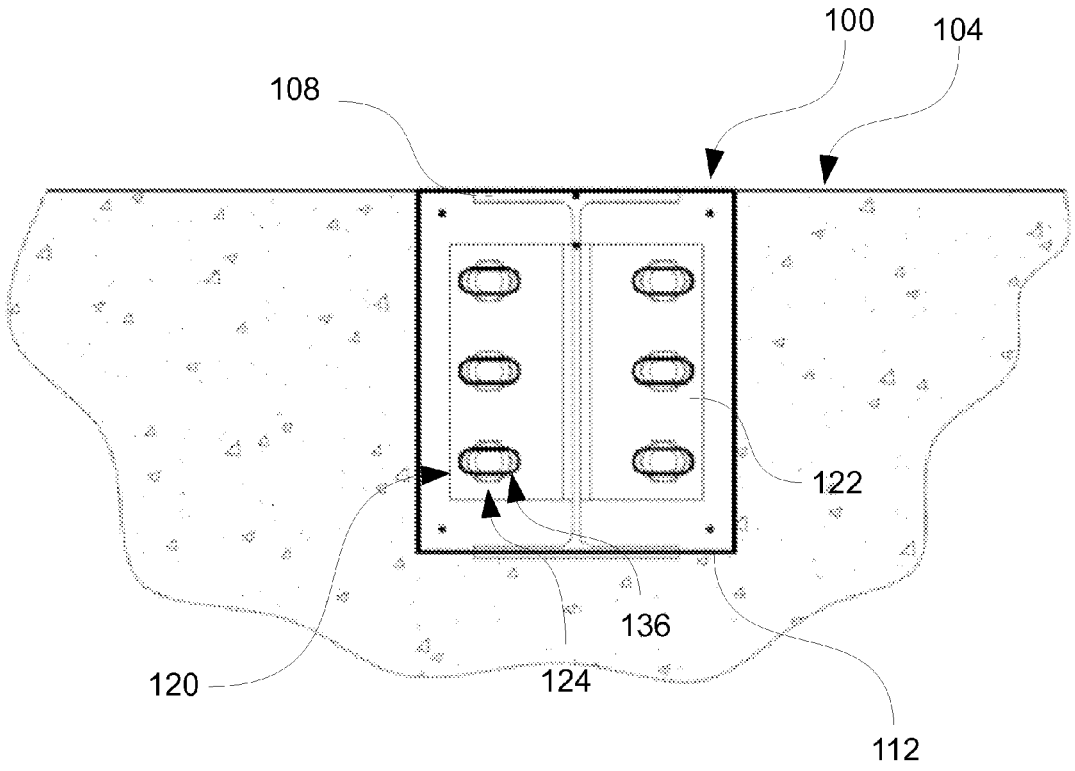
FIG. 2 is an elevation view of a steel beam support embed after installation according to an embodiment of the present invention.

Turning now to the figures, and specifically with reference to FIGS. 1 and 2, there is shown an exemplary steel beam support embed 100 installed in a concert foundation 104 and coupled to a beam 108. At a high level, and as discussed in more detail below, embed 100 includes a plate 112 including a plurality of detachable anchors 116 and a plurality of connecting ports 120. As shown in FIG. 1, detachable anchors 116 extend away from plate 112 and into concrete foundation 104, while connecting ports 120 provide mounting sites for attachment of beam 108.

Figure 3:
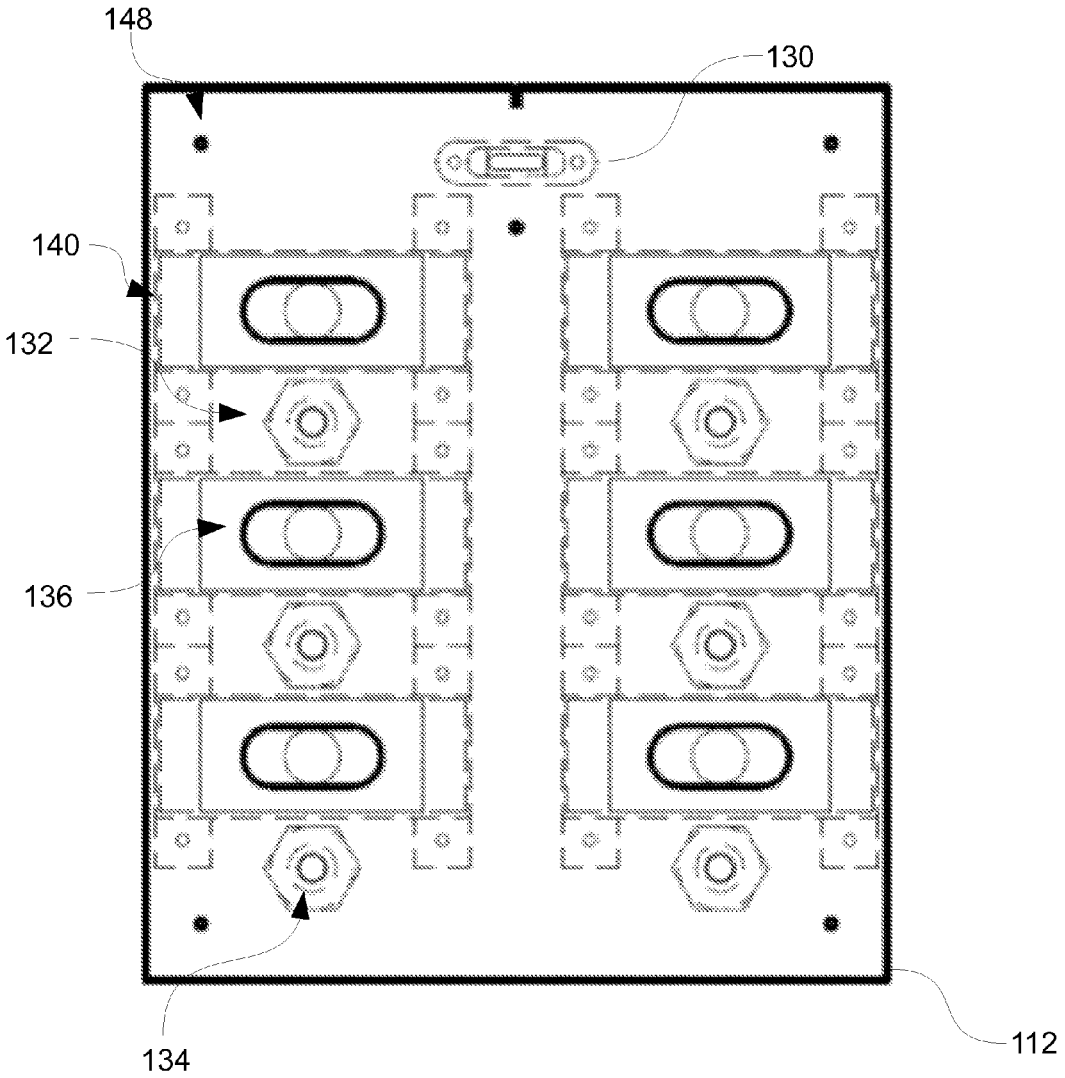
FIG. 3 is an elevation view of a steel beam support embed according to an embodiment of the present invention.
Figure 4:
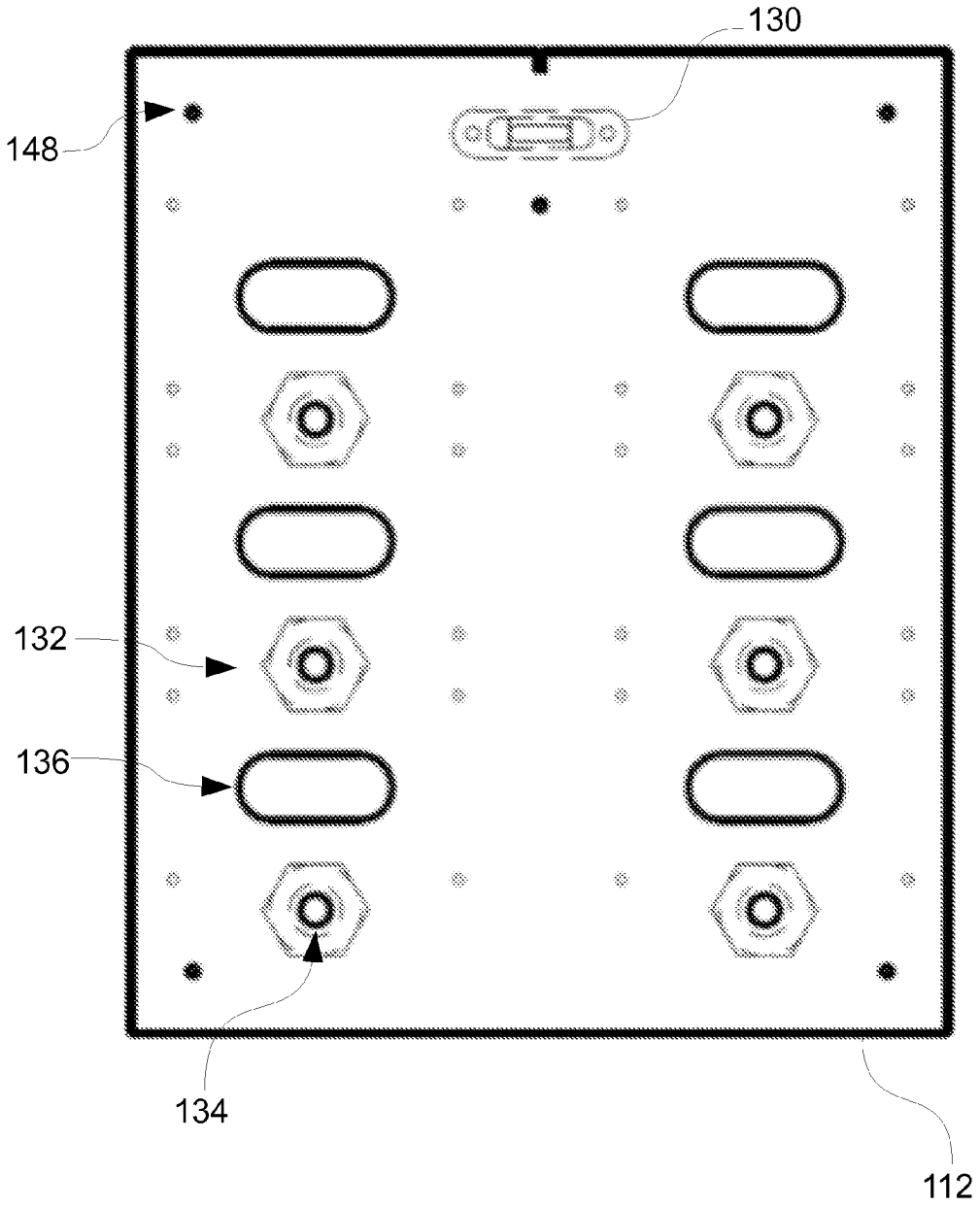
FIG. 4 is an elevation view of a steel plate support embed according to an embodiment of the present invention.

Continuing with reference to FIGS. 1 and 2, and with further reference to FIGS. 3 and 4, plate 112 is sized and configured to rest securely within the concrete foundation to provide a flat surface for mounting a beam, such as beam 108, thereto. Although shown in FIGS. 1-4 as a substantially rectangular prism, plate 112 can be most any shape known in the art, with the dimensions of plate 112 being substantially determined by the size of the beam being attached thereto. Thus, for example, as shown in FIG. 1, beam 108 has a height, "h", and by virtue of that height is coupled to a connection angle 122 with three beam mounting bolts 124. Connection angle 122 is then mounted to embed 100 via connecting ports 120 using three embed mounting bolts 128. If, however, beam 108 had a greater height, additional beam mounting bolts 124 and embed mounting bolts 128 may be used and thus plate 112 would have a greater longitudinal length and may include additional connecting ports 120 and detachable anchors 116.

In an exemplary embodiment, plate 112 may also include a mounted level 130 (FIGS. 3 and 4), which eases installation of the plate by removing the need for an installer to attempt to use an detached level.

Detachable anchors 116 (best viewed in FIGS. 1, 5, and 6) couple to plate 112, opposite beam 108, and secure the plate into concrete foundation 104 after the concrete has been poured around the detachable anchors. In an exemplary embodiment, detachable anchors 116 are threaded bolts that mate with a corresponding respective fastener 132, such as a nut, (also shown in phantom view in FIG. 3) secured to the surface of plate 112. In another embodiment, detachable anchors are unthreaded bolts or pins that slidably engage with a collar secured to the surface of plate 116. In general, the size, number, and configuration of detachable anchors 116 used in any given application will depend on the size of embed 100 and the width of concrete foundation 104, among other factors.

In an exemplary embodiment, the ends of detachable anchors 116 are marked with highly visible paint on the side that will point toward the beam 108. In this embodiment, plate 112 also includes a plurality of minor apertures 134 corresponding generally to the center of each fastener 132. This embodiment allows for ready inspection that each detachable anchor 116 has been installed as the visible paint is viewable via minor apertures 134.

Figure 5:
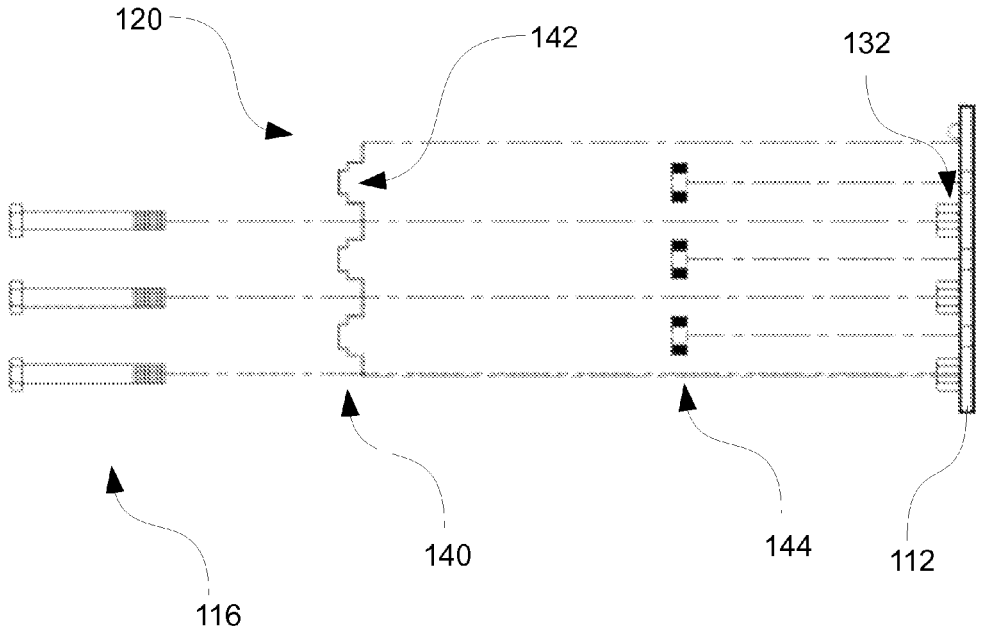
FIG. 5 is an exploded plan view of a steel beam support embed according to an embodiment of the present invention.
Figure 6:
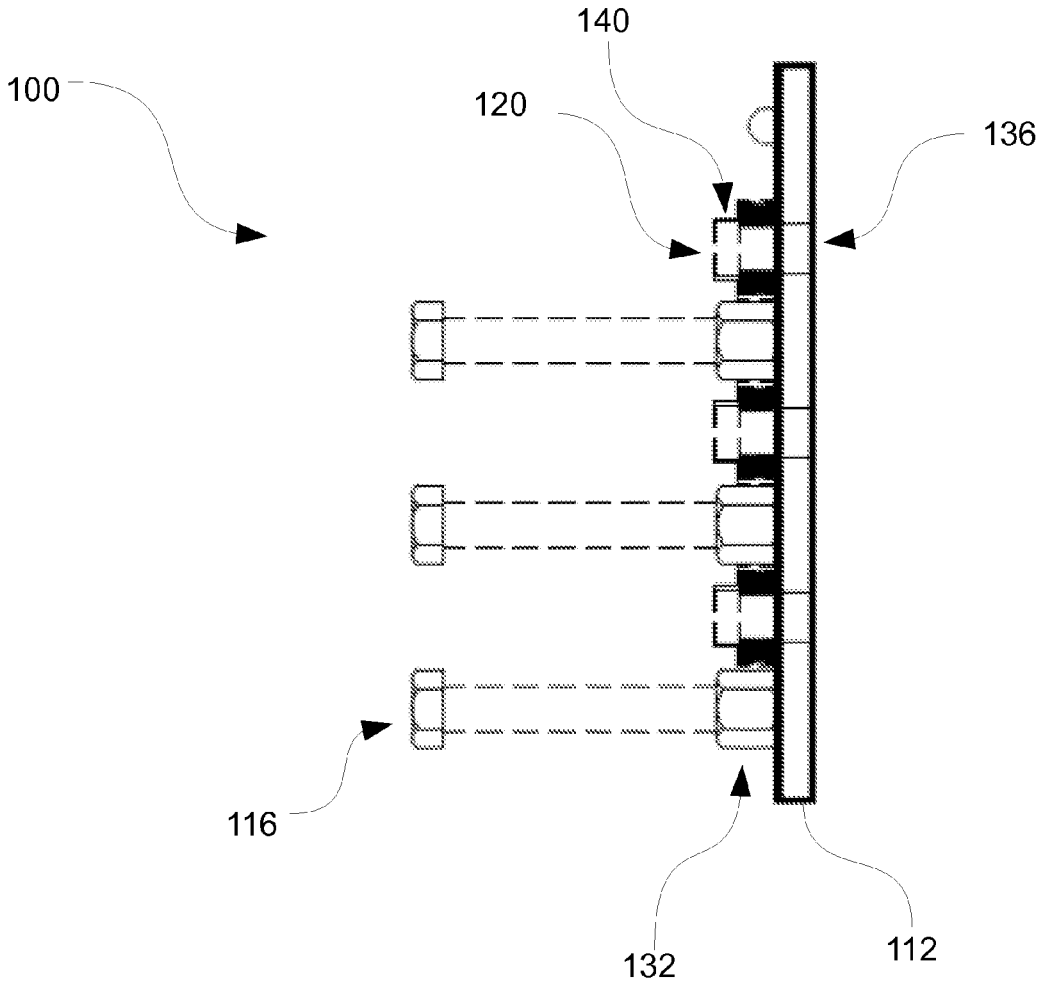
FIG. 6 is a section view of the assembled steel beam support embed of FIG. 5.

Turning now to a discussion of connecting ports 120, and with reference to FIGS. 4 and 5, the connecting ports are sized and configured to receive and couple plate 112 to beam mounting bolts 124. Connecting ports 120 include apertures 136 in plate 112. Connecting ports also include a plurality of casings 140, each of which supports a corresponding fastener 144, such as a nut. Apertures 136 are sized and configured to receive mounting bolts 124 and generally to provide for lateral movement of beam 108 when being mounted to embed 100. In an exemplary embodiment, lateral movement is accomplished by shaping apertures 136 as generally oblong.

Casings 140, shown in phantom view in FIG. 3 and cross-section view in FIG. 4, adhere to plate 112 and each provides a hollow 142 between the plate and the periphery of the casing that is maintained after concrete foundation 104 has been poured. The number of casings 140 generally corresponds to the number of apertures 136 in plate 112. In an exemplary embodiment, casings 140 are each designed and configured to receive and hold a corresponding fastener 144 (FIG. 5). In this way, when a mounting bolt, such as mounting bolt 124, is inserted into aperture 136, fastener 144 is held in place during the mounting of beam 108 to plate 112.

In use, plate 112 is leveled and tacked (using tack apertures 148, best seen in FIGS. 3 and 4) onto the concrete form for the concrete foundation at predetermined locations. Detachable anchors 116 are then affixed to plate 112 using, for example, fasteners 132 that are secured to the plate. The concrete is then poured into the concrete forms to form concrete foundation 104 (FIGS. 1 and 2). Once concrete foundation 104 has hardened, a steel beam 108 is brought into place and aligned with connection ports 120. The beam is then coupled to plate 112 using embed mounting bolts 128 via connection ports 120, each of which house, for example, fastener 144, suitable for receiving the embed mounting bolts.

Figure 7:
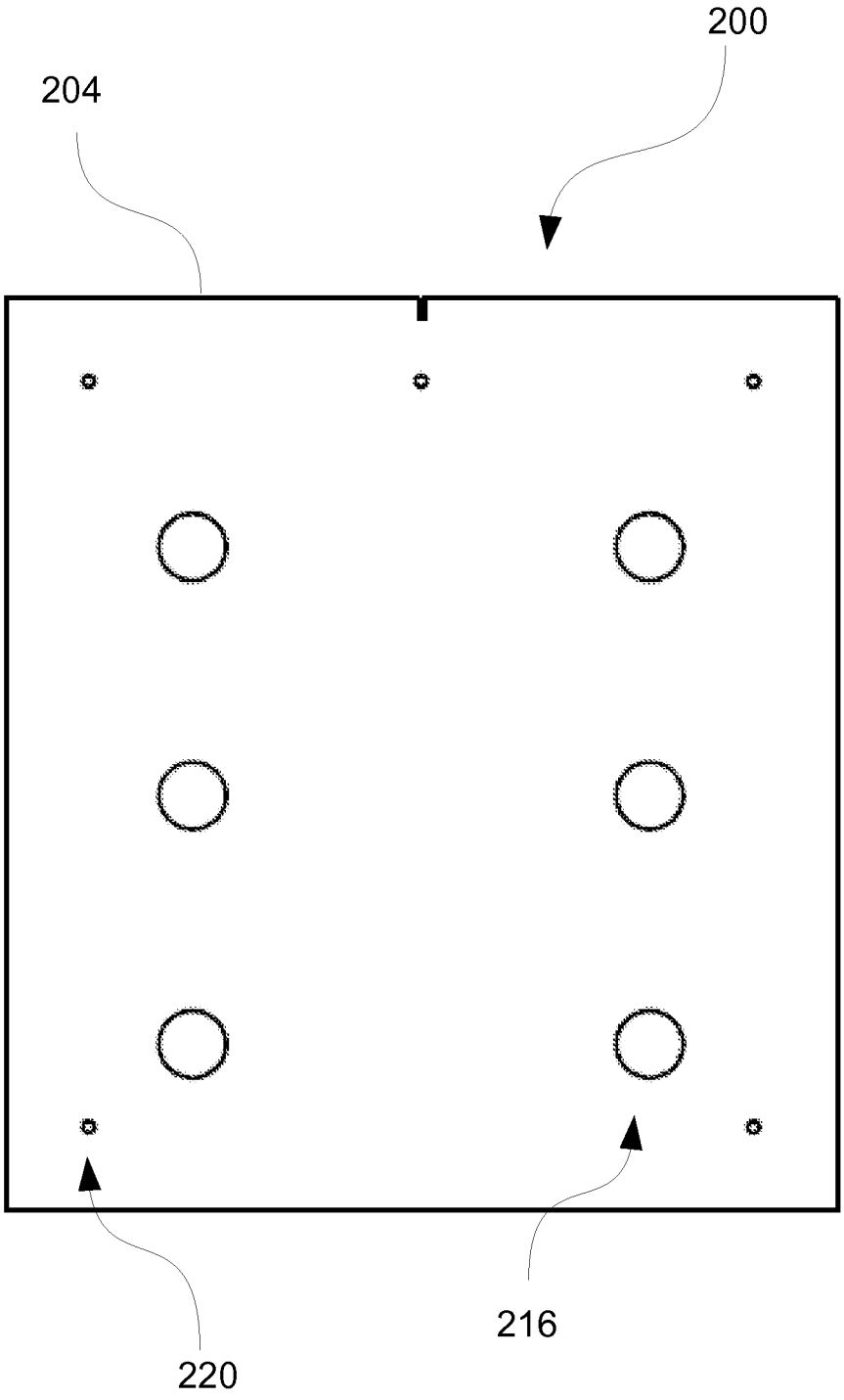
FIG. 7 is a front elevation view of a steel beam support embed according to another embodiment of the present invention.
Figure 8:
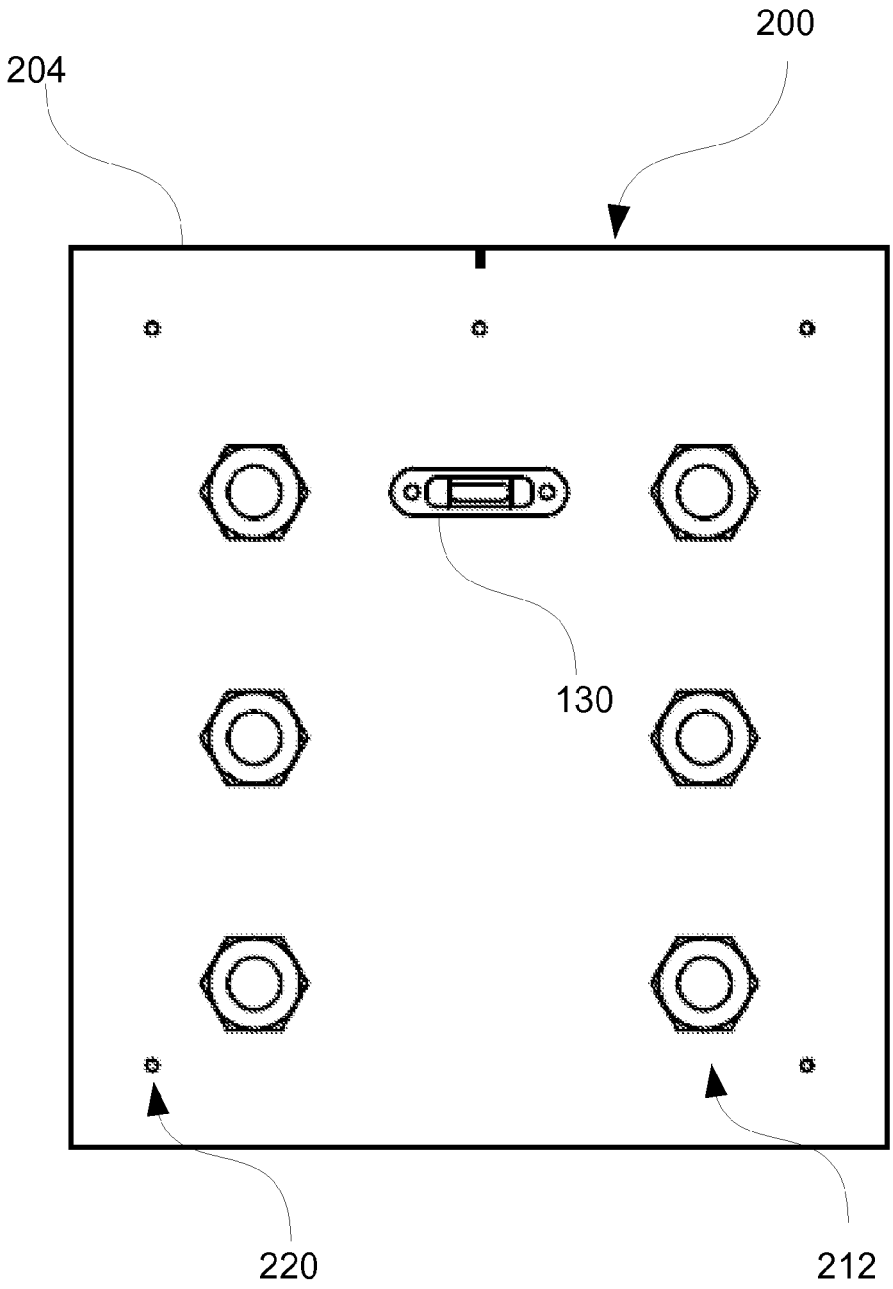
FIG. 8 is a rear elevation view of the steel beam support embed of FIG. 7.
Figure 9:
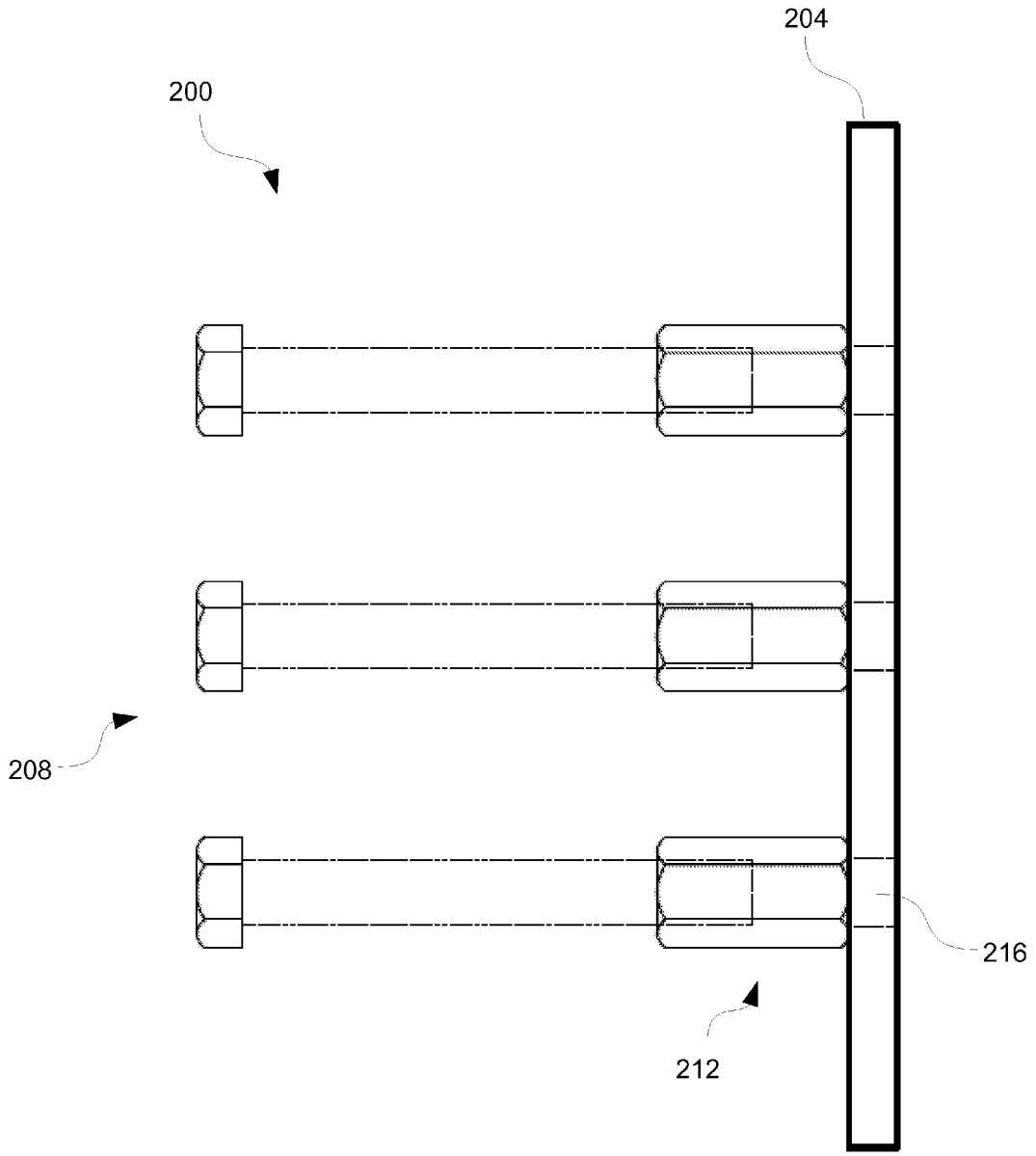
FIG. 9 is a section view of a partially assembled steel beam support embed according to another embodiment of the present invention.

Turning now to FIGS. 7 to 9, there is shown another embodiment of a steel beam support embed, steel beam support embed 200. Embed 200 includes a plate 204 including a plurality of detachable anchors 208 and a plurality of connecting ports 212. As shown in FIG. 9, detachable anchors 208 extend away from plate 204, and then into a concrete foundation (not shown) (such as concrete foundations 104 (FIG. 1) after installation and pouring of concrete. Connecting ports 212 also provide attachment sites for attachment of beam (such as beam 108 (FIG. 1) using mounting bolts, such as mounting bolts 124, through plate apertures 216 in plate 204.

As shown in FIG. 1, plate 204 includes six connecting ports 212, although fewer or additional connecting ports may be used depending on the size of plate 204 and the intended implementation. Connecting ports 212 are sized and configured to accept a respective mounting bolt (such as mounting bolts 124), so as to affix a beam to plate 204. Connecting ports 212 are also sized and configured to receive a respective detachable anchor 208 from the opposite side of plate 204 (e.g., rear of the plate). In an exemplary embodiment connecting ports 212 are sized and configured such that each mounting bolts and its opposing corresponding detachable anchor 208 are both securely installed in the same respective connecting ports 212. For example, the length of connecting ports 212 can be sufficient so that the bottoms of the mounting bolts and the detachable anchors do not contact one another. In an exemplary embodiment, detachable anchor 208 is partially threaded along its length so as to mate with corresponding threads inside a respective connecting port 212. In this embodiment, when installed in a connecting port 212, the threads on the detachable anchor 208 "bottom-out" (i.e., detachable anchor cannot go any further into the connecting port), thus providing sufficient space for adequate tightening of the mounting bolt used to affix the beam to plate 204.

Plate 204 also includes a plurality of tack apertures 220 that assist a user with installing the plate onto the concrete forms. Tack apertures 220 can be sized and configured to accept nails, screws, bolts, etc. Plate 204 can also include a mounted level 130 to assist in installation of the plate.

In an exemplary embodiment, connecting ports 212 are attached to the back of plate 204 via a process that substantially ensures appropriate alignment of a connecting port with respective plate aperture 216. Once plate apertures 216 have been formed in plate 204 (via drilling, stamping, forming, etc.), a mounting bolt, such as mounting bolts 124, is inserted through plate aperture 216 and a connecting port 212 is attached to the mounting bolt. In an exemplary embodiment, the mounting bolt and connecting port 212 have mating threads, but other coupling mechanisms could be used. When the mounting bolt is fully coupled to the connecting port 212, the connecting port can then be tack welded or otherwise attached to plate 204 and the mounting bolt can then be removed. In this way, each connecting port 212 is properly aligned with plate aperture 216 so at to ensure that during installation the mounting bolts will be coupleable to the connecting ports.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A steel beam support for attachment to a concrete form that defines an area to be filled with concrete, the steel beam support comprising:

a plate having a plurality of apertures extending therethough, wherein said plate is couplable to the concrete form;

a plurality of connecting ports coupled to said plate such that each of said plurality of connecting ports are substantially aligned with a corresponding respective one of said plurality of apertures and wherein each of said plurality of connecting ports has a threaded internal chamber, and wherein said threaded internal chamber has a first portion and a second portion, wherein said first portion is threaded in a first direction and said second portion is threaded in an opposite direction; and a plurality of detachable anchors each removably coupled to a corresponding respective one of said plurality of connecting ports, wherein, said plurality of detachable anchors are configured to extend from said plate into the area to be filled with concrete.

2. A steel beam support according to claim 1, wherein said plate includes a plurality of tack apertures.

3. A steel beam support according to claim 1, wherein said threaded internal chamber is configured to restrict the attachment of an anchor disposed therein.

4. A steel beam support according to claim 1, wherein said threaded internal chamber has a first portion, a second portion, and a third portion, and wherein said first and second portions are threaded and said third portion is disposed between said first and second portions and is unthreaded.

5. A steel beam support according to claim 1, wherein said plurality of connecting ports are coupled to a side of said plate proximate the concrete form.

6. A steel beam support according to claim 1, wherein each of said plurality of detachable anchors includes an end with a visible mark.

7. A steel beam support according to claim 1, further including a connecting angle, said connecting angle configured to be attached to a steel beam and said plate.

8. A steel beam support according to claim 7, wherein the connecting angle includes a plurality of oblong apertures extending therethrough.

* * * * *